US005509877A

United States Patent [19]

Adams

[11] Patent Number: 5,509,877

[45] Date of Patent: Apr. 23, 1996

[54] PORTABLE WEIGHT LIFTING DEVICE

[76] Inventor: Charles L. Adams, 990 Haltom Rd., Fort Worth, Tex. 76117

[21] Appl. No.: 379,760

[22] Filed: Jan. 27, 1995

[51] Int. Cl.[6] ..... A63B 21/075

[52] U.S. Cl. ..... 482/108; 482/908

[58] Field of Search ..... 482/74, 92, 93, 482/106, 108–111, 139, 908

[56] References Cited

U.S. PATENT DOCUMENTS

| | | | |
|---|---|---|---|
| 983,372 | 2/1911 | Johnson . | |
| 1,366,200 | 1/1921 | Matysek . | |
| 3,231,270 | 1/1966 | Winer . | |
| 3,311,374 | 3/1967 | Wittenberg et al. . | |
| 3,334,899 | 8/1967 | Bosko et al. | 482/108 |
| 3,756,597 | 9/1973 | Monti . | |
| 3,781,007 | 12/1973 | Baker et al. . | |
| 4,029,312 | 6/1977 | Wright . | |
| 4,076,236 | 2/1978 | Ionel . | |
| 4,103,887 | 8/1978 | Shoofler . | |
| 4,773,640 | 9/1988 | Kölbel et al. | 482/108 |
| 4,880,228 | 11/1989 | Caruthers | 482/108 |
| 4,905,992 | 3/1990 | McWain . | |
| 4,913,422 | 4/1990 | Elmore et al. . | |
| 5,431,615 | 7/1995 | Correll | 482/108 |

*Primary Examiner*—Richard J. Apley
*Assistant Examiner*—Victor K. Hwang
*Attorney, Agent, or Firm*—Charles D. Gunter, Jr.

[57] ABSTRACT

A weight lifting device, such as a dumbbell or bar bell, for exercise is provided with a handle to which a pair of fluid impermeable hollow chambers or containers are disposed at opposite ends for holding a weighting fluid. Each chamber has a sealable opening for accessing the interior of the hollow chamber and is provided with a plug for sealing the opening. A plurality of fluid displacement members are provided and are sized to pass through the sealable opening into the interior of the hollow chamber. The fluid displacement members displace a selected volume of the weighting fluid within the chambers so that the volume of fluid required to fill the chambers can be varied, thus varying the weight of the device.

17 Claims, 2 Drawing Sheets

PORTABLE WEIGHT LIFTING DEVICE

BACKGROUND OF THE INVENTION

1. Field of the Invention

This invention relates to a weight lifting device, and in particular to a weight lifting device which can be varied in weight for ease of transport and portability.

2. Description of the Prior Art

Many weight lifting devices have been developed over the years. These include conventional free weights such as bar bells and dumbbells. Conventional bar bells and dumbbells comprise a handle or bar to which weights are attached at opposite ends of the bar. The weights may be disk-shaped iron plates or plastic shells filled with a heavy material, such as sand, concrete or shot. The weights are often removable so that the weight of the bar bell or dumbbell can be adjusted by adding or subtracting the number of weights. While these weight lifting devices are quite good, they are very cumbersome, heavy to ship and cannot be transported from place to place without great effort.

Because of this, lightweight or portable bar bells and dumbbells have been developed which can be easily converted to increase their weight. In their simplest form, these weight lifting devices consist of containers which are attached or joined to a handle or bar. The containers have an opening in which a readily available material, such as water, can be introduced to increase the weight of the device. The material is then emptied from the containers to decrease its weight for portability or transport. This makes the handling of the devices much easier and allows the user to carry them from place to place with less effort. Many different embodiments of weight lifting devices employing fillable containers are known in the prior art. An example of such a device is disclosed in U.S. Pat. 3,756,597 which teaches a weight lifting device having containers mounted on either end of a bar. The containers are filled with water or other material and are provided with indicia or fill lines for determining the level of fluid needed to achieve a desired weight.

The problem with these prior art lifting devices is that in order to vary the weight within the containers, the amount of fluid or substance necessary to provide the appropriate weight may be less than that required to fill the containers. Thus, during movement of the bar bell or dumbbell, the fluid within these containers tends to slosh or move about within the container. This is distracting to the user and interferes with the enjoyment and use of the weight lifting device.

What is needed is a simple weight lifting device having containers which can be filled with a weighting fluid, such as water, so that the free space within the containers is minimized to prevent movement of the fluid within the containers, and which does not require fill lines or other indicia on the containers to determine the appropriate level of fluid for a desired weight.

SUMMARY OF THE INVENTION

A weight lifting device for exercise is provided with a handle to which a pair of fluid impermeable hollow chambers are disposed at opposite ends for holding a weighting fluid. Each chamber has a sealable opening for accessing the interior of the hollow chamber and is provided with a closure member, such as a plug, for sealing the opening. At least one fluid displacement member is provided for each chamber. The fluid displacement members displace a selected volume of the weighting fluid within the chambers so that the volume of fluid required to fill the chambers can be varied, thus varying the weight of the device.

DESCRIPTION OF THE PREFERRED EMBODIMENT

Figure 1:
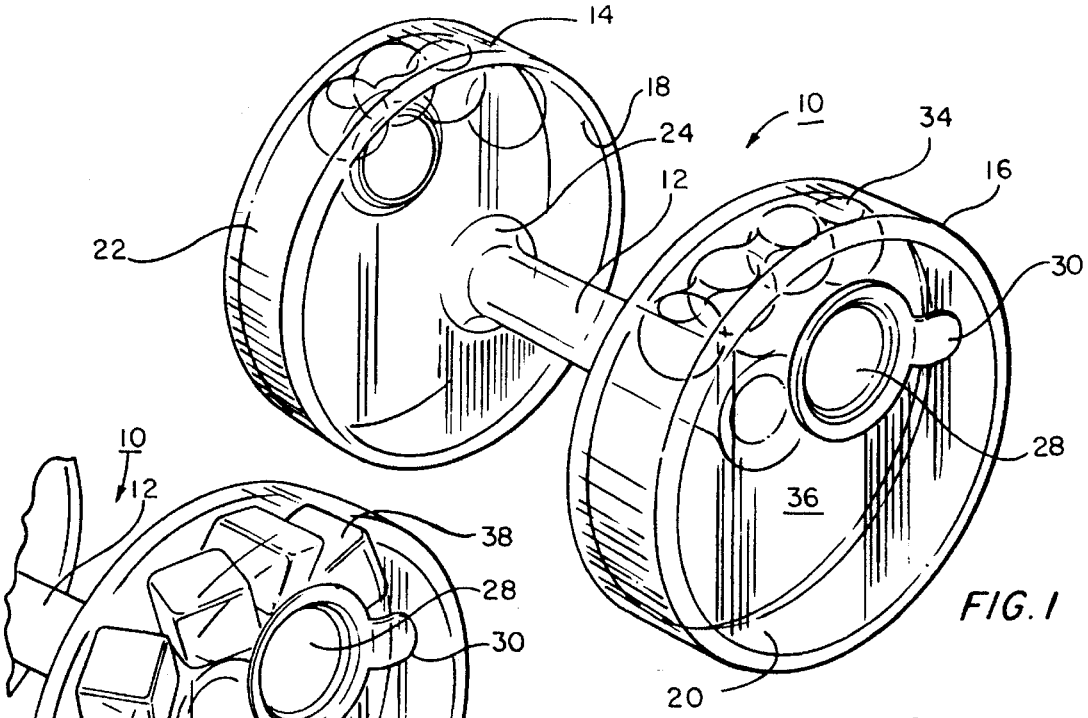
FIG. 1 is a prospective view of a weight lifting device constructed in accordance with the invention.
Figure 3:
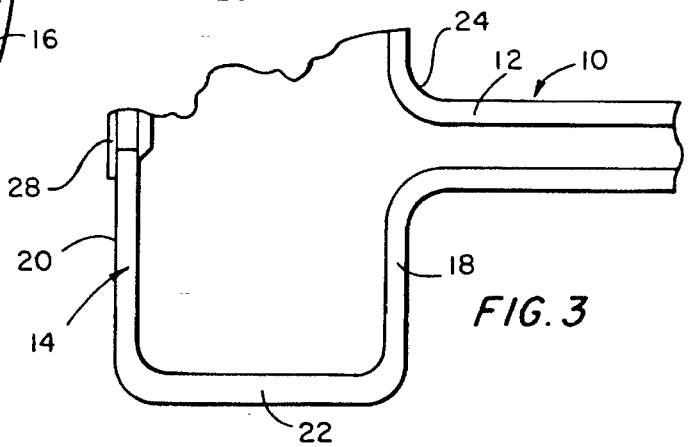
FIG. 3 is a partially exploded cross-sectional side view of the weight lifting device of FIG. 1.
Figure 2:
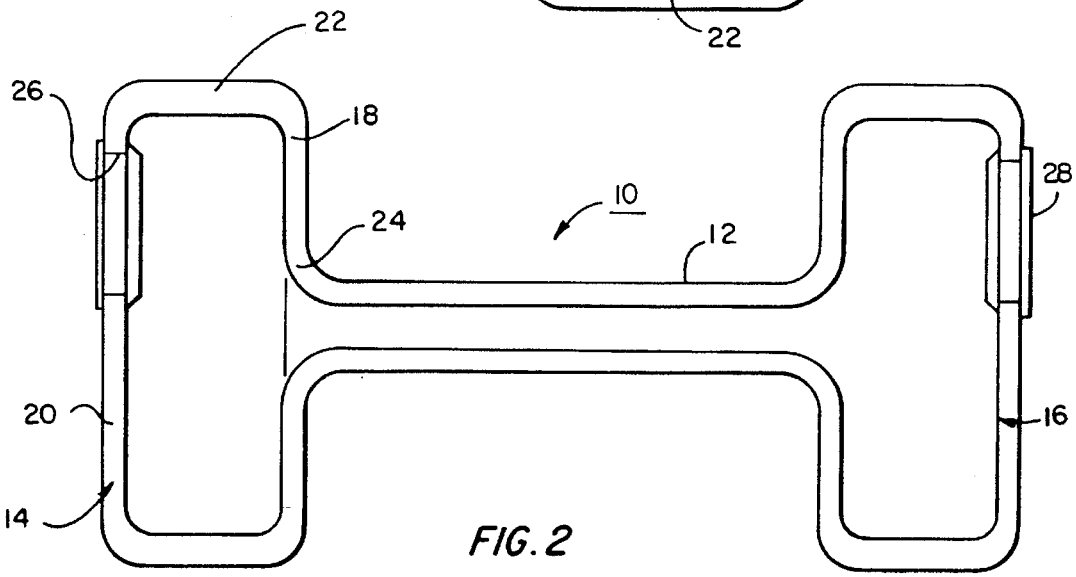
FIG. 2 is a cross-sectional side view of the weight lifting device of FIG. 2.

Referring to the figures, FIG. 1 shows a weight lifting device 10 in the form of a dumbbell, however, the device 10 may also be a bar bell. The device 10 is provided with an elongated handle 12. As seen in FIG. 2, the handle 12 extends between opposite cylindrical containers or chambers 14, 16 located at opposite ends of handle 12. It should be noted that the containers 14, 16 could be a variety of shapes such as square or polygonal. As can be seen in the embodiment of FIGS. 2 and 3, the handle 12 is hollow thus providing fluid communication between the containers 14, 16, however, the handle 12 need not be hollow nor provide fluid communication between the containers 14, 16.

Each container 14, 16 is substantially the same in size and shape with the volume of each being equal. Each container 14, 16 has a circular inner wall 18 which faces opposite a circular outer wall 20 of the same diameter. The inner and outer walls 18, 20 are concentric with the longitudinal axis of the handle 12. The inner and outer walls 18, 20 are spaced apart and are joined together by means of a cylindrical band portion 22. As can be seen in FIG. 2, the containers 14, 16 have a diameter which is substantially greater than that of the elongated handle 12.

The elongated handle 12 is substantially cylindrical in shape except for a flared portion 24 located where the handle 12 joins the inner wall 18 of the containers 14, 16. The handle 12 may be contoured to accommodate a user's hand and may have a knurled or textured exterior surface to prevent slippage of the device 10 from the hand during use.

Provided on the exterior or outer wall 20 of the containers 14, 16 are openings 26 which are eccentrically located adjacent to the outer edge or perimeter of the outer walls 20. The opening 26 could be located elsewhere on the containers 14, 16, but is preferably positioned to ensure that the containers can be completely filled or topped off with a weighting fluid.

A closure member, such as a plug 28, is provided to fit within each of the openings 26. The plug 28 is sized to fit snugly within the openings 26 to provide a sealing engagement, thereby preventing escape of fluid from each of the containers 14, 16. Each plug is provided with a pull tab 30 which enables the user to grasp the plug 28 to remove it from the opening 26. The plug 28 should fit securely within the opening 26 so that it is not easily removed or loosened during normal use of the weight lifting device 10. It will be understood that other types of closure members, such as screw-on caps, and the like, can be utilized as well.

Provided with the dumbbell 10 are a plurality of displacement members 34. The displacement members 34, as shown in the embodiment of FIG. 1, are spherical bodies which are sized to pass through the opening 26 into the interior of the containers 14, 16, but large enough to prevent passage of the members 34 through the handle 12. The displacement members 34 each displace a selected volume of weighting fluid 36 which fills the containers 14, 16. They should be formed of a material which is fluid impermeable to the weighting fluid 36 to prevent penetration or absorption of the weighting fluid 36 into the displacement members 34. This ensures that the volume of fluid within the containers 14, 16 does not change after the containers have been filled with the fluid 36.

Figure 4:
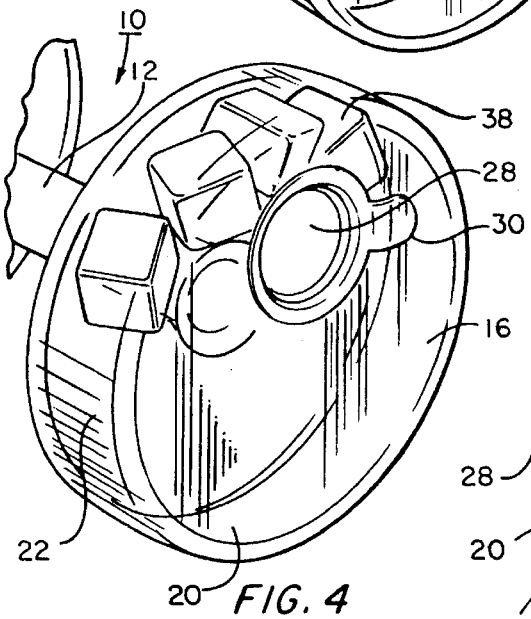
FIG. 4 is a partial perspective view of the weight lifting device of FIG. 1 with different displacement members located within hollow chambers of the device.

The displacement members 34 are preferably lightweight to minimize the weight of the device 10 when not in use. The displacement members 34 can be hollow, but are preferably formed of a lightweight, generally solid material such as "Styrofoam." The members 34 may be buoyant when placed in the weighting fluid 36, however, this is not necessary as long as they displace a desired volume of fluid. It may be desirable to have the members 34 be of different shapes. FIG. 4 shows block-shaped displacement members 38. The different shapes may correspond to different amounts of fluid displacement to make their selection easy when desiring a certain amount of fluid displacement. The members 34 may also be of different colors or be provided with other indicia to indicate different volumes of fluid displacement.

The weighting fluid 36 may be any readily available fluid that has a high enough density to create a sufficient mass for the device 10. Such fluids may be such things as water, sand or shot which are flowable to allow for easy filling and emptying of the containers 14, 16 and handle 12. The preferred weighting fluid is tap water.

In order to use the dumbbell 10 of the invention, the dumbbell 10 is provided with the displacement members 34 as a set. Initially, the dumbbell 10 would be free of fluid so that the dumbbell 10 is lightweight and easy to transport. The displacement members 34 may be stored within the containers 14, 16 when not in use to facilitate their handling and to prevent their loss.

When the user wants to use the dumbbell 10, the user chooses the appropriate weight that is desired for lifting. When the weight is chosen, the user will select the number and size of displacement members 34 needed to achieve the desired weight. Thus, for example, if the total volume of the dumbbell 10 is enough to hold seven pounds of water, the user may add additional displacement members to each of the containers 14, 16 to reduce the weight of the dumbbell to, for example, five pounds. In this instance, the user would select the number and size of displacement members 34 to displace 1.0 pounds of water in each container 14, 16. If each displacement member 34 displaced about 0.25 pounds of water, four displacement members would be required in each of the containers 14, 16. Fewer or more displacement members 34 could be used depending upon the displacement volume of the members 34.

Once the appropriate number of displacement members 34 are placed within the containers 14, 16, one of the plugs 28 is fitted within one of the openings 26 on the containers 14, 16 and securely sealed thereto. The dumbbell 10 is then filled or topped off with the fluid 36 through the other opening 26 so that the fluid 36 completely fills the containers 14, 16 and handle 12. There should be no free or empty space remaining inside the dumbbell 10 when it is filled. The other opening 26 is then sealed with the remaining plug 28 to prevent leakage of the fluid from the dumbbell 10. The user can then use the dumbbell 10 in a conventional fashion.

After use, the user merely has to remove one of the plugs 28 to drain or empty the dumbbell 10 of fluid 36. If desired, the displacement members 34 can be left or returned inside the containers 14, 16 of the dumbbell 10 for storage.

Figure 5:
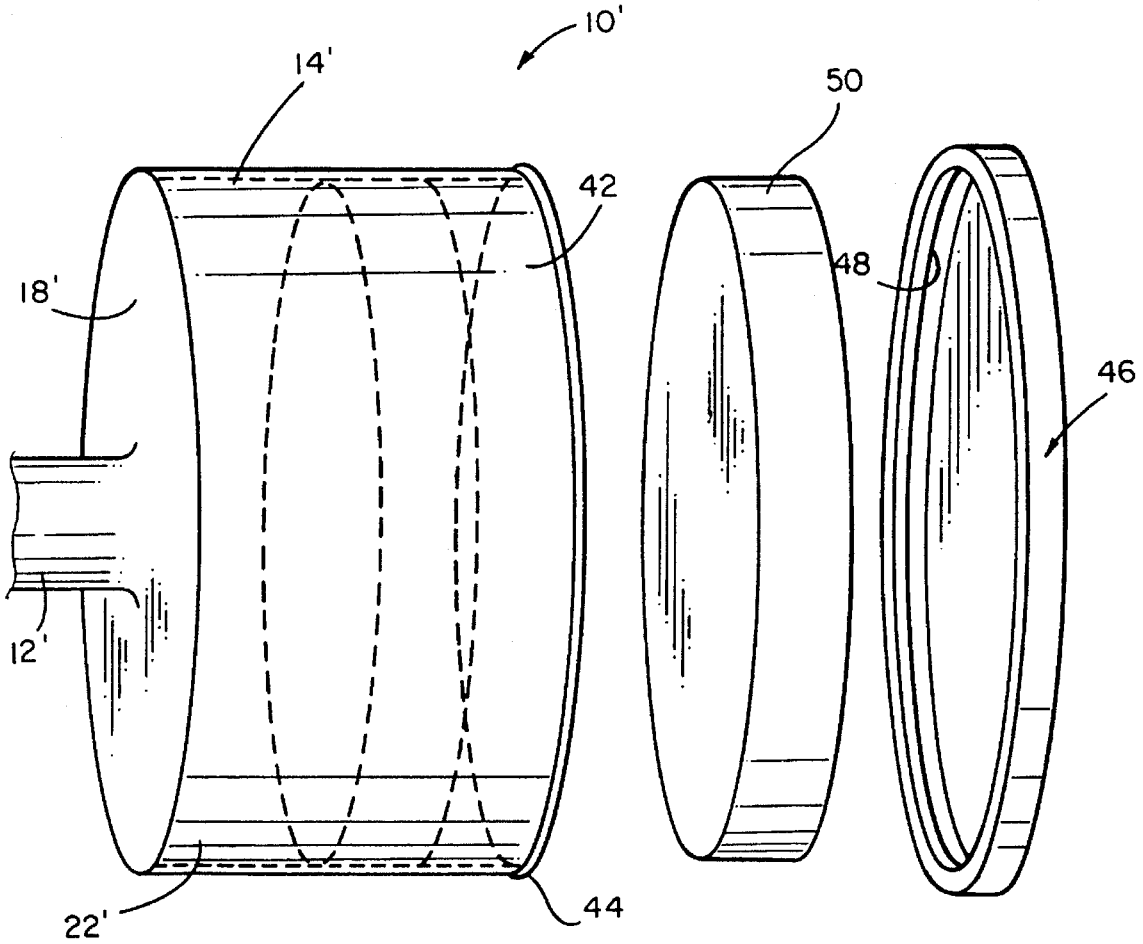
FIG. 5 is a partial perspective view of an alternate embodiment of the weight lifting device constructed in accordance with the invention.

FIG. 5 shows another embodiment of the invention as a dumbbell 10'. The dumbbell 10' is only partially shown but is similar in construction to that of FIGS. 1–4 with similar components such as the handle 12' and the inner wall 18' being designated with a prime sign. Dumbbell 10' has a cylindrical container 14', however, the outer wall is absent to provide an opening 42 having the same diameter as the inner diameter of the cylindrical portion 22'. The cylindrical portion 22' is of substantially constant diameter. A small outward protruding annular lip 44 is provided on the exterior of the cylindrical portion 22' immediately adjacent to the opening 42.

Provided with the dumbbell 10' is a flat, circular snap-on lid 46 having engagement means 48 for engaging the annular lip 44 of the cylindrical portion 22' or the container 14'. The lid 46 should be designed so that it is not easily removed or loosened during use.

Also, provided with the dumbbell 10' are a plurality of disk-shaped, displacement members 50. The displacement members 50 have an outer diameter which is slightly less than the inner diameter of the cylindrical portion 22' to minimize movement of the members 50 within the containers of the dumbbell 10'.

The operation of the dumbbell 10' is substantially the same as that of FIGS. 1–4. The interior of the containers are accessed by removing the snap-on lids 46 so that they can be filled with water or other weighting fluid and the displacement members can be removed or positioned therein. The disk-shaped displacement members 50 are positioned in a generally concentric fashion within the containers of the dumbbell 10'. If the weight lifting device 10' is not to be varied in weight, such as after shipping to a permanent location, the lid 46 can be permanently glued in place with an appropriate adhesive.

Because the weight of the device of the invention can be easily varied by adding or removing the weighting fluid, the device can be reduced in weight for ease of shipping and portability. The device can then be increased in weight prior to use. The weight of the device is determined by the number of displacement members used when it is filled, it is not necessary to provide fill line indicia on the device for determining the amount of fluid needed to provide the appropriate weight. The dumbbell is completely filled with the fluid, with the displacement members occupying the remaining space so that no empty space remains inside the dumbbell. This eliminates splashing or sloshing of the water or fluid within the dumbbell which can be distracting to the user. The displacement members take the guessing and estimation required with the fill line type lifting devices. The user knows that the exact weight has been achieved when the dumbbell is completely filled with fluid so that no empty space remains.

While the invention has been shown in only two of its forms, it should be apparent to those skilled in the art that it is not so limited but is susceptible to various changes without departing from the scope of the invention. For instance, it is envisioned that in one particular embodiment, the displacement members be expandable air bladders which locate within the interior of the containers. The air bladders would be filled with air to an appropriate volume by the use of a self-sealing rubber valve and inflation needle, such as those used for inflatable footballs and the like.

I claim:

1. A weight listing device for exercise comprising:

a handle;

a pair o fluid impermeable hollow chambers disposed at opposite ends of the handle for holding a weighting fluid, each chamber having a sealable opening for accessing the interior of the hollow chamber;

a closure member for sealing each opening of the chamber;

at least one fluid displacement member which locates within the interior of each chamber, the at least one fluid displacement member displacing a selected volume of the weighting fluid within each chamber so that the volume of fluid required to fill the chambers can be varied to thus vary the weight of the device; and wherein the fluid displacement members are hollow, fluid impermeable bodies.

2. The device of claim 1, wherein:

the handle is also hollow and in fluid communication with each of the chambers.

3. The device of claim 1, wherein:

the fluid displacement members are buoyant within the weighting fluid.

4. The device of claim 1, wherein:

the handle and hollow chambers are formed from a lightweight polymeric material.

5. A weight lifting device for exercise comprising:

a handle;

a pair of fluid impermeable hollow chambers disposed at opposite ends of the handle for holding a weighting fluid, each chamber having a sealable opening for accessing the interior of the hollow chamber;

a closure member for sealing each opening of the chamber;

at least one fluid displacement member which locates within the interior of each chamber, the at least one fluid displacement member displacing a selected volume of the weighting fluid within each chamber so that the volume of fluid required to fill the chambers can be varied to thus vary the weight of the device; and wherein the fluid displacement members are each color coded to indicate different volumes of fluid displacement.

6. A weight lifting device for exercise comprising:

a handle;

a pair of fluid impermeable hollow chambers disposed at opposite ends of the handle for holding a weighting fluid, each chamber having a sealable opening for accessing the interior of the hollow chamber;

a closure member for sealing each opening of the chamber;

at least one fluid displacement member which locates within the interior of each chamber, the at least one fluid displacement member displacing a selected volume of the weighting fluid within each chamber so that the volume of fluid required to fill the chambers can be varied to thus vary the weight of the device; and wherein the fluid displacement members are hollow, fluid impermeable bodies of different shapes to indicate different volumes of fluid displacement.

7. A weight lifting device for exercise comprising:

a handle;

a pair of fluid impermeable hollow chambers disposed at opposite ends of the handle for holding a weighting fluid, each chamber having a sealable opening for accessing the interior of the hollow chamber;

a closure member or sealing each opening of the chamber;

at least one fluid displacement member which locates within the interior of each chamber, the at least one fluid displacement member displacing a selected volume of the weighting fluid within each chamber so that the volume of fluid required to fill the chambers can be varied to thus vary the weight of the device; and wherein the handle is also hollow and in fluid communication with each of the chambers and the fluid displacement members are oversized to prevent passage of the fluid displacement members through the handle.

8. A weight lifting device for exercise comprising:

an elongated handle;

a pair of fluid impermeable hollow chambers disposed at opposite ends of the handle for holding a weighting fluid, each chamber having a sealable opening for accessing the interior of the hollow chamber, the handle and hollow chambers being integrally formed from a lightweight polymeric material;

a closure member for sealing each opening of the chamber;

a plurality of buoyant fluid displacement members which are sized to pass through the sealable opening into each hollow chamber, the fluid displacement members displacing a selected volume of the weighting fluid within the chambers so that the volume of weighting fluid required to fill the chambers is varied to thus vary the weight of the device; and wherein the fluid displacement members are hollow, fluid impermeable bodies.

9. The device of claim 8, wherein:

the fluid displacement members are each color coded to indicate different volumes of fluid displacement.

10. The device of claim 8, wherein:

the fluid displacement members have different shapes to indicate different volumes of fluid displacement.

11. The device of claim 8, wherein:

the handle is also hollow and in fluid communication with each of the chambers.

12. A method of varying the weight of a weight lifting device for use in exercise, the method comprising the steps of:

providing a pair of fluid impermeable hollow chambers disposed between opposite ends of a handle, each chamber holding a volume of weighting fluid and having a sealable opening for accessing the interior of the hollow chamber;

providing a plurality of fluid displacement members which are sized to pass through the sealable opening into each hollow chamber, each fluid displacement member having a selected volume;

placing a selected number of the fluid displacement members within each of the chambers through the openings so that the volume required to fill the chambers with a weighting fluid is at a value to achieve a desired weight of the device;

filling the chambers with the weighting fluid through the opening; and then sealing the opening of each chamber to prevent the leakage of the fluid from the chambers; and wherein the fluid displacement members are hollow, fluid impermeable bodies.

13. The method of claim 12, wherein:

the fluid displacement members are each color coded to indicate different volumes of fluid displacement.

14. The method of claim 12 wherein:

the fluid displacement members are of different shapes to indicate different volumes of fluid displacement.

15. The method of claim 12, wherein:

the handle is also hollow and in fluid communication with each of the chambers; and further comprising the step of sealing one of the sealable openings after placing the fluid displacement members within each chamber.

16. The method of claim 12, wherein:

the handle and hollow chambers are formed from a lightweight polymeric material.

17. The device of claim 12, wherein:

the fluid displacement members are buoyant within the fluid.

* * * * *